US007823608B2

(12) United States Patent
Mettler

(10) Patent No.: US 7,823,608 B2
(45) Date of Patent: Nov. 2, 2010

(54) SHAFT ROD AND HEALD SHAFT

(75) Inventor: Franz Mettler, Wollerau (CH)

(73) Assignee: Groz-Beckert KG, Albstadt (DE)

( * ) Notice: Subject to any disclaimer, the term of this patent is extended or adjusted under 35 U.S.C. 154(b) by 362 days.

(21) Appl. No.: 11/522,464

(22) Filed: Sep. 18, 2006

(65) Prior Publication Data

US 2007/0062596 A1 Mar. 22, 2007

(30) Foreign Application Priority Data

Sep. 16, 2005 (DE) ..... 10 2005 044 474

(51) Int. Cl.
*D03C 9/06* (2006.01)

(52) U.S. Cl. ..... 139/91; 139/92

(58) Field of Classification Search ..... 139/91–96
See application file for complete search history.

(56) References Cited

U.S. PATENT DOCUMENTS

| | | | | | |
|---|---|---|---|---|---|
| 407,078 | A * | 7/1889 | Ladd | 139/91 |
| 3,693,343 | A * | 9/1972 | Assmus et al. | 368/159 |
| 3,754,577 | A * | 8/1973 | Heller | 139/92 |
| 4,484,604 | A * | 11/1984 | Kramer et al. | 139/92 |
| 4,790,357 | A * | 12/1988 | Kramer | 139/91 |
| 4,901,767 | A | 2/1990 | Koch | |
| 4,913,194 | A * | 4/1990 | Kramer | 139/91 |
| 5,183,082 | A * | 2/1993 | Baumann | 139/92 |
| 2005/0061385 | A1 * | 3/2005 | Gesing | 139/91 |
| 2005/0081941 | A1 | 4/2005 | Schmid et al. | |

FOREIGN PATENT DOCUMENTS

| | | |
|---|---|---|
| DE | 3702524 | 11/1988 |
| DE | 3937657 | 7/1990 |
| DE | 4101512 | 6/1992 |
| DE | 10349382 | 9/2005 |
| EP | 0288652 | 2/1988 |
| JP | 2005-89957 A | 4/2005 |

* cited by examiner

*Primary Examiner*—Shaun R Hurley
*Assistant Examiner*—Andrew W Sutton
(74) *Attorney, Agent, or Firm*—Fitch, Even, Tabin & Flannery; Norman N. Kunitz

(57) ABSTRACT

The shaft rod (2) according to the invention has, at one of its narrow sides, at least one recess (21) which is later provided in the shaft rod and in which a reinforcing element (24) is glued. The material externally of the shaft rod forms securing zones (32, 33) which serve for the attachment of additional elements. The recesses are preferably applied in such a manner that hollow spaces free from Eloxal coating are exposed which may be utilized as recesses into which reinforcing elements are glued.

18 Claims, 7 Drawing Sheets

SHAFT ROD AND HEALD SHAFT

CROSS REFERENCE TO RELATED APPLICATION

This application claims the priority of German patent application No. 10 2005 044 474.1, filed Sep. 16, 2005, the subject matter, in its entirety, is incorporated by reference.

BACKGROUND OF THE INVENTION

The invention relates to a shaft rod for weaving machines and a heald shaft having at least one such a shaft rod.

Heald shafts are subject to increasing requirements concerning their load bearing capacity. Such requirements originate in the increasing operating speed (rpm) of the weaving machines which, for economical reasons, have to operate with an ever increasing output and thus an ever increasing productivity. To be able to construct, within the limited structural space of a weaving machine, a heald shaft which may satisfy the above requirements, shaft rods are necessary which, in the first place, are highly resistant to bending in the direction of motion which, as a rule, is vertical.

In the prior art various proposals are known concerning the configuration of shaft rods. Only a few of such proposals, however, have proved to be practical. For example, German Patent Document No. DE 39 37 657 discloses a shaft rod composed of side parts and reinforcing sections. The manufacture of such shaft rods, however, involves substantial outlay and is therefore expensive.

German Patent Document No. DE 41 01 512 discloses an arrangement which is limited to the use of steel. Such a construction has met with some success because of the use of relatively inexpensive materials. Weight considerations, however, set limits to such a construction.

A further proposal is set forth in European Patent Document No. EP 0 288 652. The proposed excessive use of expensive fiber reinforcements is, however, a substantial impediment to an economic success.

An interesting arrangement is described in German Patent Document No. DE 103 49 382 which discloses the manufacture of a shaft rod, starting from a single-chamber or multi-chamber extruded aluminum member which is provided at its ends with a reinforcing element running out in a wedge-shaped manner. The reinforcing element is glued to the aluminum body. For introducing the reinforcing element into the aluminum body, for example, an originally closed chamber of the extruded aluminum member is opened at least toward one side by partially removing the wall of the extruded member present in that region. The reinforcing element may be introduced through the thus-obtained elongated opening into the shaft rod and glued thereto. Based on this concept, lightweight, yet rigid shaft rods may be economically manufactured. However, difficulties are encountered in securing driving elements to such a shaft rod. Further, the adhesive bond between the reinforcing element and the shaft rod may prove to be the weak region of the construction.

It is the object of the invention to provide an improved shaft rod.

SUMMARY OF THE INVENTION

The above object generally is achieved with the shaft rod according to the invention.

The shaft rod according to the invention has, in its first embodiment, a basic body provided with a web which is situated at its narrow side and in which a recess is formed. The recess preferably does not pierce the web; rather, it forms an only unilaterally open pocket which is surrounded by a wall on five sides. This may be achieved, for example, by providing that the depth of the recess formed in the web is less than the thickness of the web. The bottom which borders the elongated recess or pocket is not pierced. To make this possible even if reinforcing elements are to be provided, whose thickness is greater than the wall thickness of the basic body, the thickness of the respective web is preferably significantly greater than the wall thickness of the basic body at its flat sides. For example, the web may have an at least approximately square cross section. The formation of a very massive web which permits the provision of deeper pockets, has the advantage at the same time that the parts of the web remaining outside the recesses may constitute securing locations for other elements, such as driving elements.

Starting from an extruded aluminum member, the manufacture of shaft rods may be flexible and directed to various conditions. For example, on the extruded member, cut to the desired size, first those locations are determined to which no reinforcing elements are to be secured. At those locations nothing is removed from the massive web. Between those locations longitudinal recesses or pockets may be provided, for example, by a milling process. The reinforcing elements are then secured into those pockets.

Preferably adhesive technology is resorted to for securing the reinforcing elements. Since the recesses are closed at the bottom, the reinforcing elements may be glued to the aluminum members at least at three sides which ensures a reliable attachment of the reinforcing element even if an equally high quality for all adhesive locations is not successfully achieved in mass production. Unavoidably present weak locations of the adhesive bond between the reinforcing elements and the aluminum basic body have barely an adverse effect, if any, due to the large overall adhesive surface.

According to a preferred embodiment, reinforcing elements are applied to both webs of the shaft rod in a parallel, spaced relationship to one another. The reinforcing elements consist preferably of the same material. This permits the operation of the heald shaft or the shaft rod at a temperature which differs from the temperature prevailing during its manufacture. In this form the shaft rod consists of at least three materials: aluminum for the basic member, steel for the shaft staves and fiber-reinforced plastic for the reinforcing elements. Normally, this would result in a significant bending of the shaft rod during operation. Such a bending would very rapidly render the web shaft useless, because, for example, the healds arranged in series thereon could no longer be shifted due to the thermal deformation. The provision of two reinforcing elements of the same type at oppositely located narrow sides of the shaft rod avoids such an occurrence and maintains such thermal deformation within acceptable limits.

In a modified embodiment of the invention, it is permissible that the recess for receiving the reinforcing element pierces the web. The web in this instance has a significantly greater thickness than the basic body of the shaft rod in its other portions. In this manner, externally of the reinforcing elements, the remaining thick web portions provide for the possibility of an attachment of external elements, such as driving elements. An attachment of reinforcing elements is possible at arbitrary locations. At the locations designed for attachment, the web is not removed, but remains available as a force-introducing location. At the remaining locations the web may be entirely or partially removed for providing receiving spaces for the reinforcing elements and for reducing the weight of the shaft rod.

The reinforcing element preferably has a cross-sectional shape which is the same as the recess. This ensures the desired three-sided gluing of the reinforcing element to the basic body. The reinforcing elements and, accordingly, the recesses, have preferably a rectangular cross section. It is, however, also feasible to use, within the spirit of the invention, other cross-sectional shapes, such trapezoidal, U-shaped, or semicircular cross sections. Further, a reinforcing element having a circular cross section may be glued into a recess of semicircular cross section.

Further, it is taken into consideration that the reinforcing element has a longitudinal sectional shape which equals that of the recess. This makes possible a five-sided gluing of the reinforcing element to the basic body. While such an arrangement is not a necessity, it is important that the recesses and, accordingly, also the ends of the reinforcing elements do not end abruptly in the length direction of the shaft rod. Rather, it is sought to allow the ends of the recess to run out gradually, by providing that the recesses end flattened in run-out zones. Accordingly, the ends of the reinforcing elements are preferably wedge shaped or ramp shaped. Such an arrangement avoids the occurrence of abrupt cross-sectional changes in the shaft rod and thus abrupt changes in the rigidity thereof. This prevents shaft rod breakages due to high dynamic stresses which otherwise would occur should the rigidity of the shaft rod change locally very substantially. The run-out of the recesses may be linear or arcuate. In this connection it is sought to design the length of the terminal zone to be minimum twice and maximum four times the depth of the recess. The longitudinal sectional shape of the recess and that of the reinforcing element agree with one another in the run-out zones, but they may differ from one another. The noted length of the run-out zone makes it possible, for example, to provide the recess with an arcuate end and the reinforcing element with a linearly extending, wedge shaped end, without risking disadvantages concerning rigidity.

In a preferred embodiment of the shaft rod according to the invention, the shaft rod is provided at its outer side with an Eloxal layer which increases its scratch resistance and reduces its tendency to corrosion. The recess for receiving the reinforcing element, however, remains free from any Eloxal coating. Nevertheless, an Eloxal layer may be present at the ends of the recess; it is less interfering there. This complies with the manufacturing reliability and the required strength of the shaft rod. It has been found that the adhesive bond between the reinforcing element and the basic aluminum body may be significantly improved by the absence of the Eloxal layer. Such conditions are obtained, for example, by first maintaining closed a hollow channel present in the extruded aluminum member, while providing the basic body with an Eloxal layer at its outer face. The electrolyte acting on the basic aluminum body may possibly penetrate into the channels of the basic aluminum body, but an Eloxal layer will be formed at the most only on short regions at the ends. Web portions are removed only after completing the Eloxal process, to thus laterally open the hollow channel. Thus, in gluing in the reinforcing element, Eloxal-free wall regions of the shaft rod are affected, where a firm adhesive joint is to be provided.

The process is even more reliable if first massive web regions are formed into which the desired recesses are milled following the Eloxal process. The thus-obtained recess has a non-oxidized wall to which reinforcing elements may be securely bonded by gluing.

The reinforcing elements are preferably plastic elements having preferably high-molecular and unidirectionally aligned fibers, such as carbon fibers. Such reinforcing elements may be formed along the entire length of the shaft rod on that side thereof which faces the shaft stave. Preferably, however, at the end of the shaft rods portions are left free.

At the opposite side too, at least one end-to-end extending throughgoing reinforcing element may be provided. Preferably, the groove-like, lengthwise extending recess does not reach the end faces of the shaft rod. Rather, a short, for example, a few tens of a millimeter long portion of the massive web remains, to which other elements, such as corner connectors, driving elements and the like may be attached. It is likewise feasible to interrupt the recess at other locations, for example, at one, two or more locations for accommodating driving elements there. In lieu of a throughgoing reinforcing element, thus several profiled pieces are utilized which correspond to the lengths of the recess portions obtained, based on the desired structure. In all instances the profiled pieces are glued to three longitudinal sides. The open side of the recesses, where the reinforcing elements are unsupported to a certain extent, lies preferably in the motion direction of the shaft.

By virtue of the three-sided gluing, very large adhesive surfaces are obtained which ensure a high reliability of the shaft rod which constitutes a rigid and deformation-proof construction. It may be adapted flexibly and economically to the conditions and requirements of a specific weaving machine construction without the need of considering, to a greater extent, losses concerning strength properties. It is also feasible to structure only one shaft rod of the heald shaft, preferably the upper shaft rod, according to the invention and to use a conventional aluminum member for the lower shaft rod. Such a solution is particularly sensible in case several driving locations are present at the lower shaft rod. Based on the short, free bending length of the lower shaft rod, its extent of bending in such an application is maintained within limits. Applying expensive reinforcing elements to the lower shaft rod would not be sensible for economical considerations. In contrast, with the shaft rod according to the invention, if used as the upper shaft rod of the heald shaft, for large weaving width of, for example, in excess of 280 cm, no intermediate reinforcing braces are needed which would ensure the distance between the upper and the lower shaft rods. Such intermediate braces which always adversely affect the quality of the weave, may be dispensed with. The shaft rod according to the invention which serves as the upper shaft rod has a sufficient rigidity to maintain the extent of bending within acceptable limits despite the different bending lengths between the upper and the lower shaft rods. In this manner an economically particularly advantageous solution is obtained.

Further advantageous details of embodiments of the invention are contained in the drawing, the description and/or the claims.

BRIEF DESCRIPTION OF THE DRAWINGS

In the drawing, which illustrates embodiments of the invention.

DETAILED DESCRIPTION OF THE INVENTION

Figure 1:
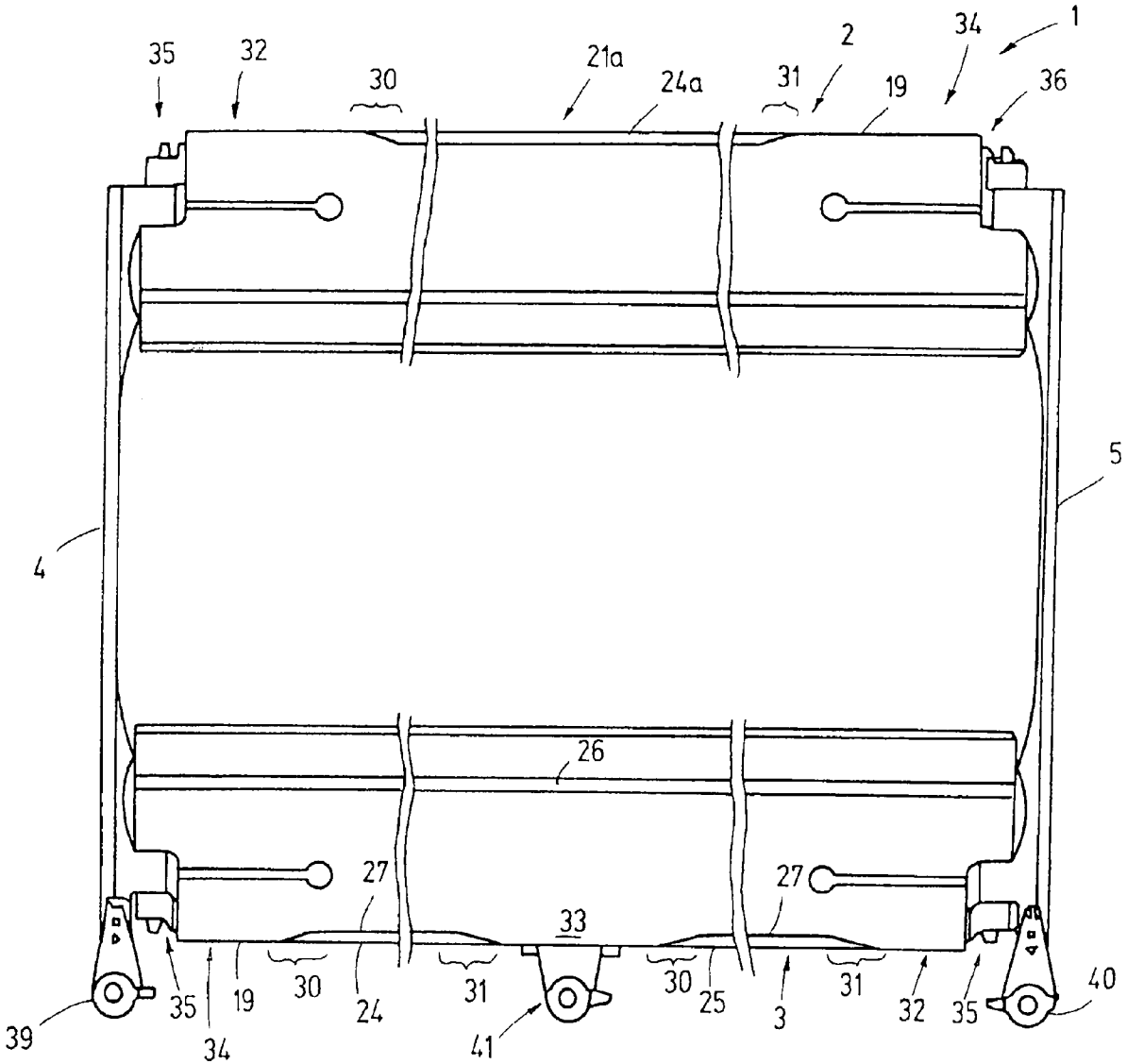
FIG. 1 is a schematic front elevation of an inventive heald shaft, an inventive upper shaft rod and an inventive lower shaft rod.

FIG. 1 shows a heald shaft 1 which forms part of a rapidly operating weaving machine. The heald shaft comprises an upper shaft rod 2 and a lower shaft rod 3 which are connected to one another by end binders 4, 5. Between the shaft rods 2, 3 healds (not shown) are arranged which serve for guiding warp yarns in the weaving machine (also not shown).

Figure 2:
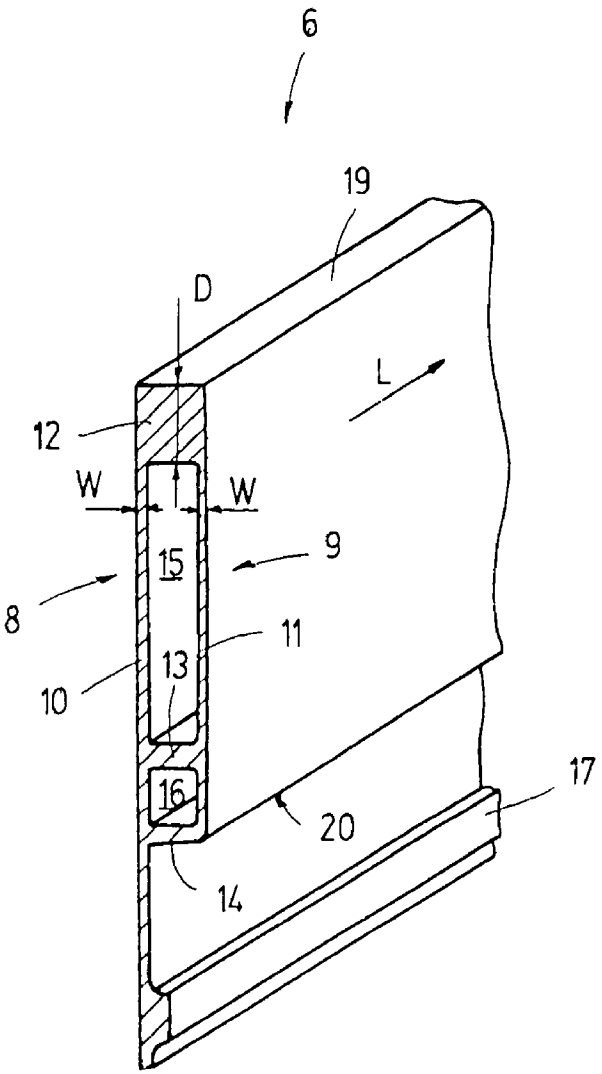
FIG. 2 is a schematic perspective view of an extruded aluminum member for the manufacture of the shaft rod according to the invention.

The particularity of the heald shaft 1 resides in the structure of its shaft rods 2, 3. FIG. 2 shows an extruded aluminum member 6 for making therefrom a basic body 7 (shown, for example, in FIG. 3) for the shaft rod 2 or 3. The extruded aluminum member 6 has two flat sides 8, 9 which can again be found in the basic body 7 according to FIG. 3. The flat sides are defined by mutually parallel walls 10, 11 which, at their outer sides oriented away from one another, may be flat, profiled, or structured and may have recesses or raised portions in the form of flat surfaces, ribs or the like.

The walls 10, 11 of the basic body 7 which is in its entirety a one-piece structure, as well as the walls of the extruded aluminum member 6, are connected to one another by webs 12, 13, 14. The upper web 12, which is preferably of massive structure, has an approximately square cross section. Its thickness D (shown in FIG. 2) is significantly greater than the thickness W (also shown in FIG. 2) of the walls 10, 11. The thickness D of the web 12 is preferably greater than the inner width of the hollow space 15 enclosed between the walls 10, 11.

Between the webs 13, 14 a further hollow space 16 is enclosed whose cross section preferably equals to, or is slightly less than, the cross section of the web 12. The wall 10 extends downward from the web 12 and is provided with a rib 17 for receiving a shaft stave 18 as shown, for example, in FIG. 4 or 5. In this manner, the shaft stave 18 or, respectively, the rib 17 is provided on that side of the basic body 7 (or extruded aluminum member 6) which is remote from the massive web 12.

The extruded aluminum member 6 shown in FIG. 2 is, at its outer side, provided with an Eloxal layer, that is, with an electrolytically produced, smooth and scratch-proof aluminum oxide layer. Such a layer covers the flat sides 8, 9, the web 12 on its flat side 19, the web 14 on its externally lying narrow side 20 as well as the wall portion 10 together with the rib 17 for supporting the shaft stave 18. The hollow spaces 15, 16 are essentially void of aluminum oxide, that is, in any event, no Eloxal layer is present. Nevertheless, an Eloxal layer may extend from the end face of the extruded aluminum member 6 for a few centimeters into the outward exposed hollow spaces 15, 16. Such a layer, however, does not extend deeper into the hollow spaces 15, 16.

Figure 3:
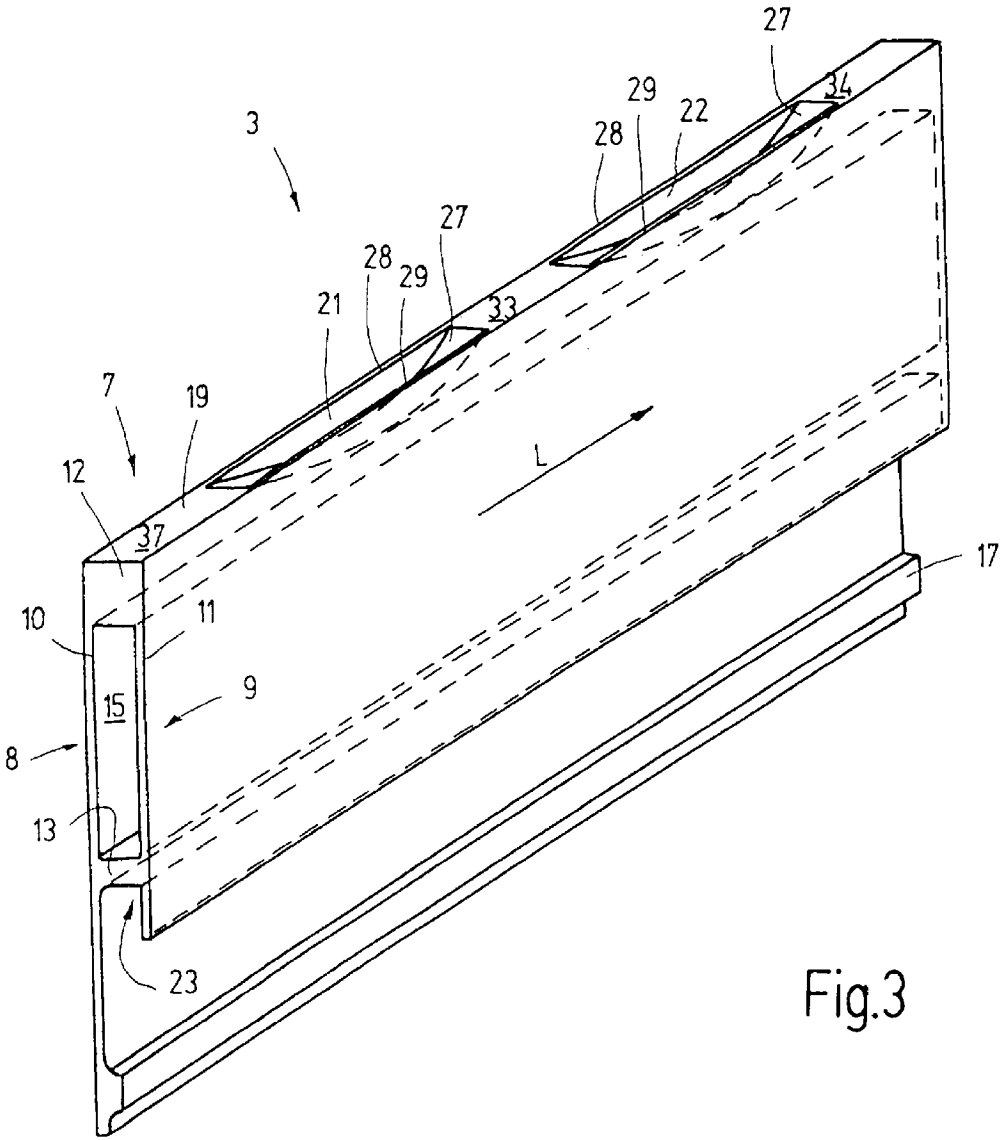
FIG. 3 is a schematic perspective view of an extruded aluminum member for receiving reinforcing elements for the manufacture of a shaft rod.

As seen in FIG. 3, at both its narrow sides 19, 20, the extruded aluminum member 6 is provided with recesses 21, 22, 23 for receiving reinforcing elements 24, 25, 26 which are schematically shown on the shaft rod 3 in FIG. 1. The recesses 21, 22 are milled into the massive web 12 as elongated components. They extend in the length direction L (shown in FIG. 3) of the shaft rod 3 which corresponds to the length direction of the extruded aluminum member 6. The recesses 21, 22 pass through the narrow side 19 without piercing the rib 12. Accordingly, the recesses 21, 22 have a closed bottom 27 and closed side walls 28, 29. As seen in FIG. 1, the bottom 27 extends along relatively long portions of the shaft rod 3, essentially parallel to the narrow side 19. In the end regions, which form run-out zones 30, 31, the depth of the recesses 21, 22 decreases in the shape of a linear or curved ascending ramp. The ascension may be arcuate, S-shaped or may have another shape. The recesses 21, 22 preferably have a uniformly constant-remaining width, that is, the distance between the side walls 28, 29 is constant.

The side walls 28, 29, as well as the bottom 27 are free from an Eloxal coating. The recesses 21, 22 are worked into the extruded aluminum member 6 after the Eloxal process and thus have essentially blank metal surfaces.

Between the recesses 21, 22 as well as at the ends of the shaft rod 3, the web 12 is essentially not weakened. In these regions securing zones 32, 33, 34 are formed, to which driving devices or other force-introducing or force-withdrawing elements may be secured.

The length of the securing zones 32, 33, 34, measured in the length direction L, may be adapted to the requirements in each instance. Such length is, for example, between 20 mm and 60 mm. Between the securing zones 32, 33, 34 where the recesses 21, 22 are provided, only a thin-walled residue remains from the web 12. At that location beneath the bottom 27 the wall thickness may be in the order of magnitude of the wall thickness W of the walls 10, 11.

As further shown in FIG. 3, the web 14 is removed either along the entire length of the shaft rod or at least along a portion thereof. Thus, from the hollow space 16 the recess 23 is formed which is open toward the rib 17 and thus open toward the shaft stave to be supported by the rib 17. The recess 23 has, similarly to the recesses 21, 22, for example, a substantially rectangular or square cross section which, however, is constant over the length direction L of the shaft rod 3. Further, the recess 23 is essentially free from Eloxal layers. Preferably, the web 14 is removed only after the Eloxal treatment of the extruded aluminum member 6, whereby the wall of the recess 23 is free from Eloxal layers at three sides.

In a subsequent working step the reinforcing elements 24, 25, 26 are glued into the recesses 21, 22, 23. The reinforcing elements 24, 25, 26 are of a fiber-reinforced plastic or another light-weight, tension-proof material. Preferably a carbon fiber-filled plastic is utilized in which the carbon fibers are introduced into the reinforcing element in a random orientation or in alignment with the length direction.

The reinforcing element 24, 25, 26 is provided with an adhesive at its outer surfaces and is inserted into the recesses 21, 22, 23. In this manner the reinforcing element is glued at least at three sides to the respective recess 21, 22, 23, in particular to the side walls 28, 29 and the bottom 27 of the recesses 21, 22.

Figure 4:
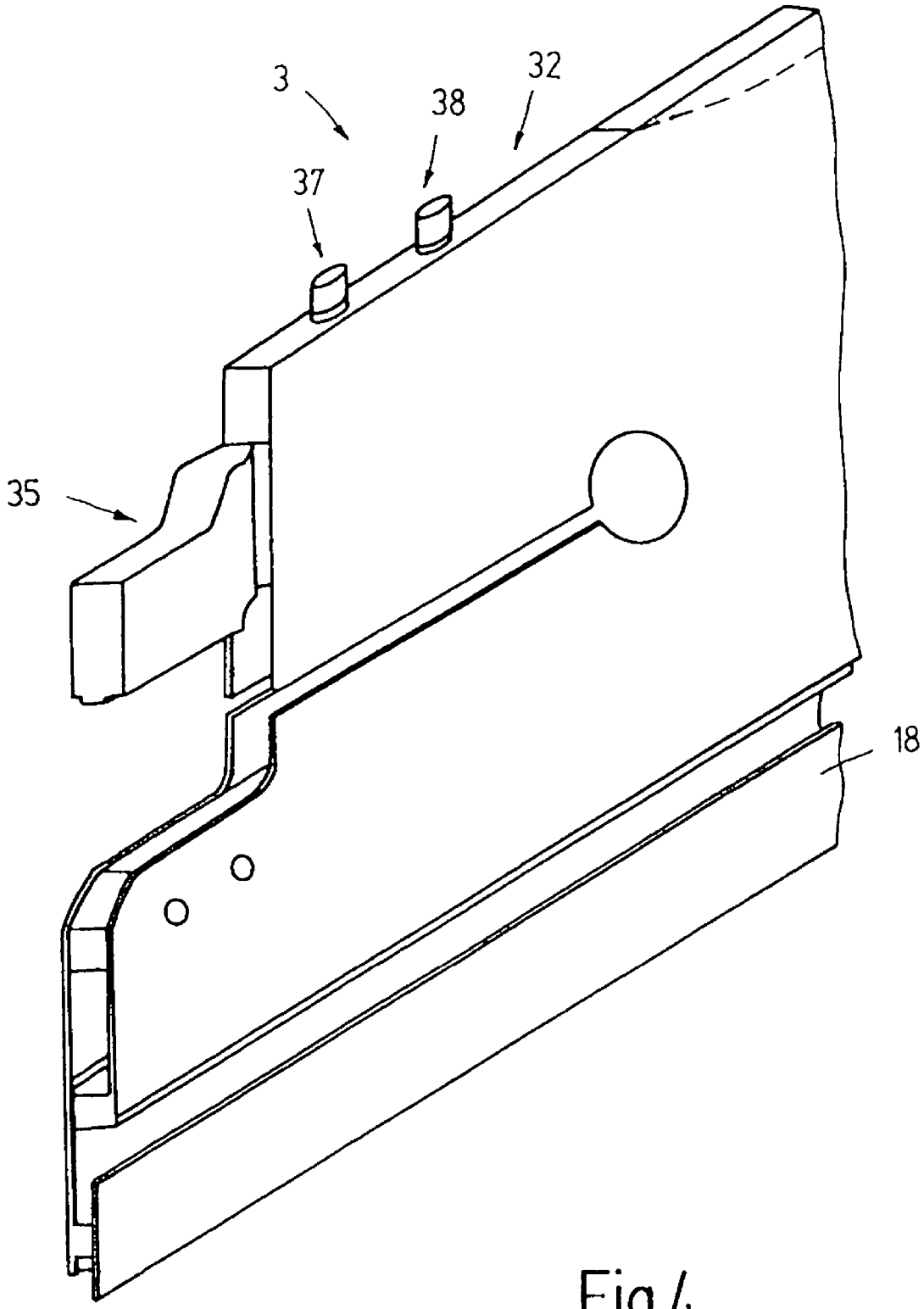
FIG. 4 is a fragmentary perspective view of a shaft rod according to the invention having a milled recess and a glued-in reinforcement.

As a finishing work on the shaft rod 3, the latter, as seen in FIG. 4, is provided at its ends (see also FIG. 1) with corner connectors 35, 36 which may be pushed into, and secured in, the hollow chamber 15. For such a securing, machine screws 37, 38 may be used which are screwed into corresponding threaded bores situated in the securing zones 32, 34. The securing zones 32, 34 serve as stable force-introducing and force-withdrawing zones. Further, tightening forces may be taken up at these locations for securing the edge connectors 35, 36 without risking deformations or damages of the shaft rod 3. Further, the driving forces introduced into the end binders 4, 5 through the driving connections 39, 40 may be transmitted to the shaft rod 3.

For supporting the drive, a further driving connection 41 may be attached to the securing zone 33 in which, for this purpose, corresponding threaded bores for the holding screws of the driving connection 41 may be provided.

As may be observed in FIG. 1, the shaft rod 2 is essentially identical to the shaft rod 3. The middle securing zone 33 is, however, missing. The two recesses 21, 22 are combined into a throughgoing, common recess 21*a* in which a sole reinforcing element 24*a* is held by an adhesive at least at three surfaces. The run-out zones 30, 31 in this instance too, provide a stepless transition to the un-pierced narrow side 19. The length of the recess 21*a* corresponds to the distance between the two securing zones 32, 34 which are at least sufficiently long for ensuring that the shaft rod 2 may take up without any damage the driving forces and tightening forces emanating from the corner connectors 35, 36.

Figure 5:
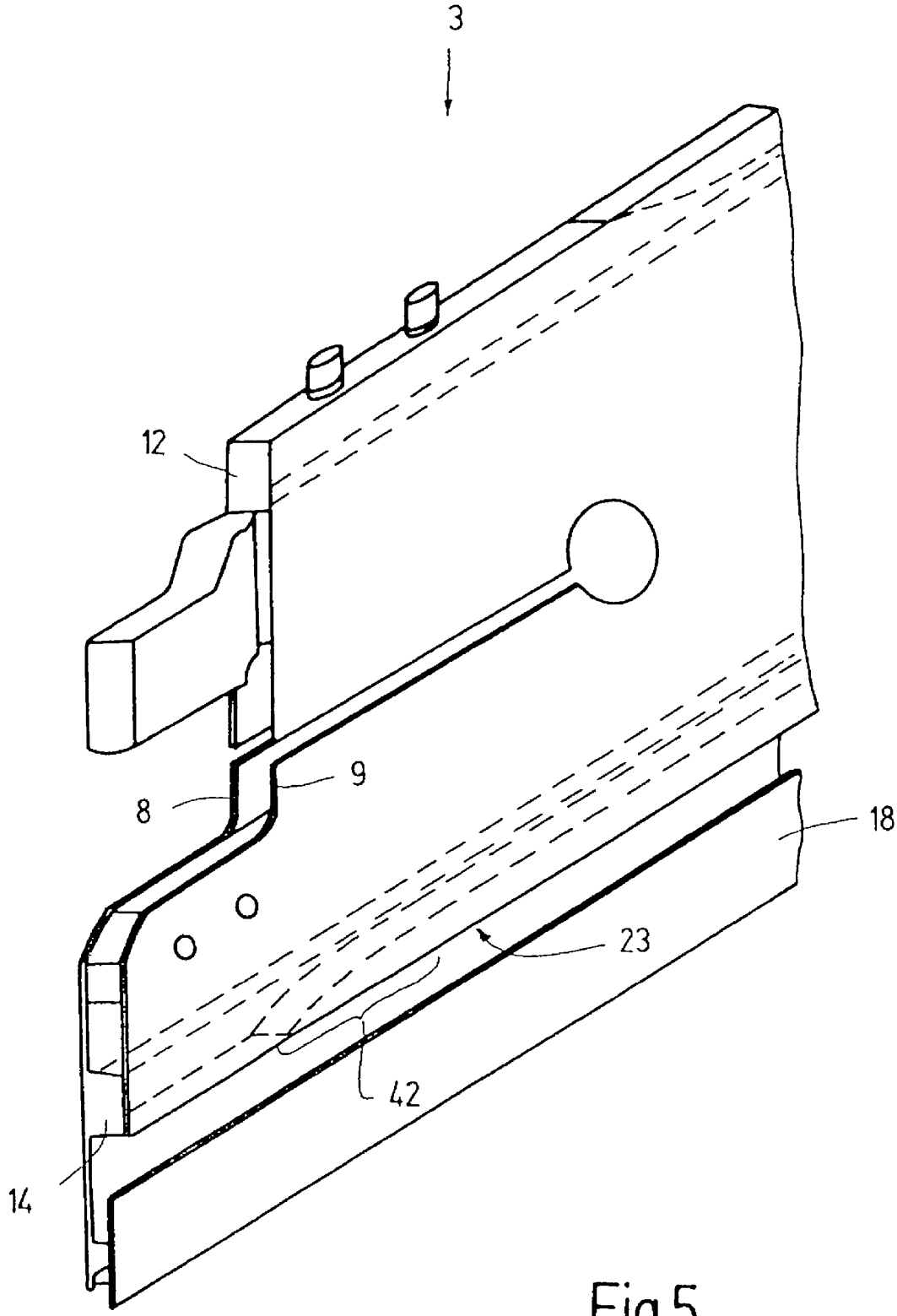
FIG. 5 is a perspective view of a modified embodiment of the shaft rod according to the invention.

FIG. 5 shows a modified embodiment of the shaft rod 2 or 3, whose particularity resides in that the web 12 as well as the web 14 are massive webs, whose height measured parallel to the flat sides 8, 9 preferably at least equals their width measured between the flat sides 8, 9. The earlier description fully applies to the upper web 12 and to the arrangement of the recesses as well as to the reinforcing elements 24, 25. In contrast to the earlier description, however, the web 14 is not removed in its entirety, but is merely provided with a groove-like pocket which constitutes the recess 23. The latter extends almost over the entire length of the shaft rod 3, but terminates before reaching the end faces thereof. The recess 23, as shown in FIG. 5, preferably terminates in a run-out zone 42 in which its depth gradually decreases, while its width remains constant. The recess 23 ends in the same manner at the other end of the shaft rod 3.

The shaft rod 3 of FIG. 5, similarly to the earlier described shaft rods 2, 3 according to FIGS. 1 to 4, offers many possibilities for arranging edge connectors, driving elements and other additional elements, particularly in or at the securing zones 32, 33, 34 where the massive webs 12 or, respectively 12 and 14, are not significantly weakened.

Figure 6:
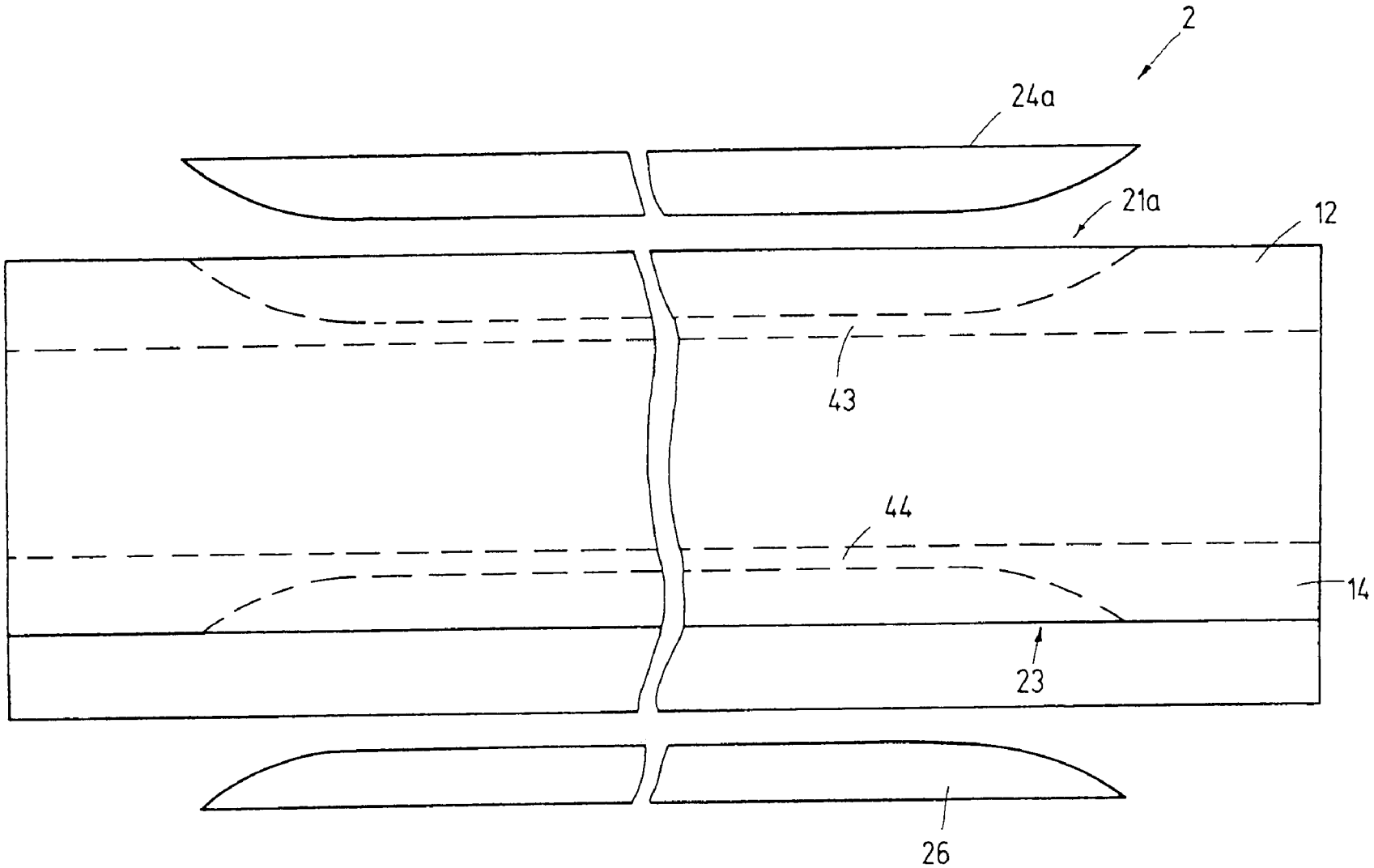
FIG. 6 is an exploded, schematic front elevation of a shaft rod according to the invention.

FIG. 6 illustrates a shaft rod 2 which, like the shaft rod 3 according to FIG. 5, has a massive upper web 12 and a similarly massive lower web 14. In both webs 12 and 14 recesses 21*a*, 23 are provided which are grooves bordered by planar flanks. In each instance the grove bottom forms a thin web 43, 44 whose thickness lies approximately in the order of magnitude of the wall thickness of the shaft rod 2. At the ends of the recesses 21*a*, 23 the groove depth gradually decreases, whereby a stepless beginning and end of the groove is obtained. The reinforcing elements 24*a*, 26 have a shape complemental to the recesses 21*a*, 23; this applies to both the cross-sectional and the longitudinal sectional shape. In a modified embodiment the longitudinal sectional shape of the reinforcing elements 24*a*, 26 may, particularly in the end regions, differ from the longitudinal sectional shape of the recesses 21*a*, 23.

Figure 7:
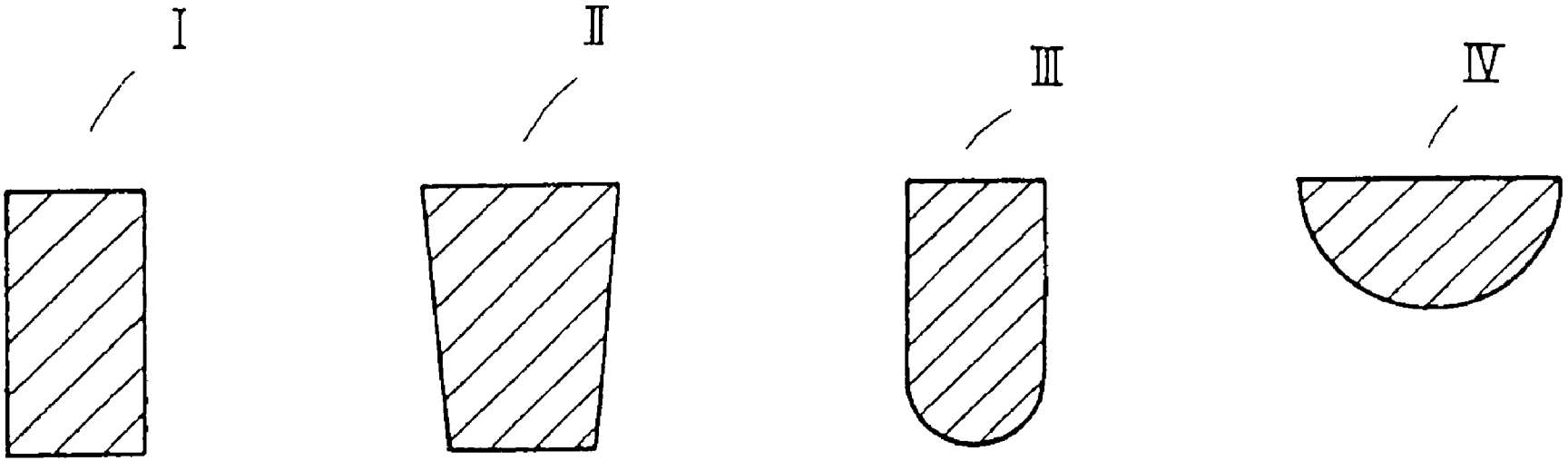
FIG. 7 shows cross-sectional views of various reinforcing elements.

As a starting point in the preceding description, the reinforcing elements 24, 25, 26 have the rectangular cross section I shown in FIG. 7. The recesses 21 to 23 as well as the reinforcing elements 24 to 26, however, may have a different cross section, according to FIG. 7, such as a trapezoidal cross section II, a rounded rectangular cross section III or a semicircular cross section IV. In these embodiment too, the cross section of the recess preferably agrees with that of the respective reinforcing element. It is also feasible to combine different cross sections at the two opposite webs 12, 14 of the shaft rod 2, 3. It is further noted that along the length of the shaft rod 2 or 3 more than two reinforcing elements 24, 25 may extend if correspondingly more recesses are provided. Between such recesses then in each instance securing zones may be present.

The shaft rod 2 according to the invention has, at one of its narrow sides, at least one recess 21 which is later provided in the shaft rod and in which a reinforcing element 24 is glued. The material externally of the shaft rod forms securing zones 32, 33 which serve for the attachment of additional elements. The recesses are preferably applied in such a manner that hollow spaces free from Eloxal coating are exposed which may be utilized as recesses into which reinforcing elements are glued.

LIST OF REFERENCE CHARACTERS:

1 heald shaft
2, 3 shaft rod
4, 5 end binders
6 extruded aluminum member
7 basic body
8, 9 flat sides
10, 11 walls
12, 13, 14 webs
15, 16 hollow space
17 rib
18 shaft stave
19, 20 narrow side
21, 22, 23, 21*a* recesses
24, 25, 26, 24*a* reinforcing elements
27 bottom
28, 29 side walls
30, 31 run-out zones
32, 33, 34 securing zones
35, 36 corner connectors
37, 38 machine screws
39, 40, 41 driving connections
42 run-out zone
43, 44 web
D thickness
W wall thickness
L length direction
I rectangular cross section
II trapezoidal cross section
III rounded rectangular cross section
IV circular or semicircular cross section The invention claim is:

1. A shaft rod for a weaving machine, comprising:

a hollow, elongated basic body having two flat sides and, therebetween, at least two spaced webs which form the narrow sides of the basic body, at least one elongated recess which is provided in an outer narrow edge surface of at least one web, which extends only along part of the length of the narrow edge surface, which does not pierce the web and which is closed at the flat sides, with said recess, at its longitudinal ends, gradually decreasing in depth from a recess bottom to the outer narrow edge surface to form a ramp to the narrow edge surface in a run-out zone, and a reinforcing element arranged in the recess and glued to the basic body.

2. The shaft rod as defined in claim 1, wherein at least one of the webs has a thickness (D), measured from the edge surface in a direction parallel to the side surfaces of the body, which is greater than the wall thickness (W) of the basic body at the flat sides.

3. The shaft rod as defined in claim 1, wherein the basic body is a single-piece component.

4. The shaft rod as defined in claim 1, wherein the basic body is a profiled aluminum member.

5. The shaft rod as defined in claim 1, wherein the reinforcing element has a cross-sectional shape which is identical to that of the recess.

6. The shaft rod as defined in claim 1, wherein the reinforcing element has a longitudinal sectional shape which is identical to that of the recess.

7. The shaft rod as defined in claim 1, wherein the reinforcing element has a longitudinal sectional shape which is not identical to that of the recess.

8. The shaft rod as defined in claim 1, wherein the length of the run-out zones is at least twice the depth of the recess.

9. The shaft rod as defined in claim 1, wherein the length of the run-out zones is a maximum of four times the depth of the recess.

10. The shaft rod as defined in claim 1, wherein the recess has a depth which is significantly greater than the wall thickness (W) of the basic body at the flat sides.

11. A shaft rod for a weaving machine, comprising:

a hollow, elongated basic body having two flat sides and, therebetween, at least two spaced webs which form the narrow sides of the basic body, at least one elongated recess which is provided in an outer narrow edge surface of at least one web, which does not pierce the web, which extends only along part of the length of the narrow edge surface, which is closed at the flat sides, and which at its longitudinal ends, gradually decreases in depth from a recess bottom to the outer narrow edge surface to form a ramp to the narrow edge surface in a run-out zone;

a reinforcing element arranged in the recess and glued to the basic body; and wherein one of the webs has at least two of said recesses containing reinforcing elements provided one behind the other in the length direction.

12. The shaft rod as defined in claim 1, wherein the web provided with the at least one recess defines, externally of the longitudinal ends of the recess, a securing zone for elements to be connected with the shaft rod.

13. A heald shaft having at least one shaft rod as defined in claim 1.

14. The heald shaft as defined in claim 13, wherein said at least one shaft rod is not connected with a driving device.

15. The shaft rod as defined in claim 1, wherein an outer surface of said basic body is provided with an Eloxal layer.

16. The shaft rod as defined in claim 1, wherein at least one elongated recess which is closed toward the flat sides of the basic body is provided in an outer narrow side surface of each of said webs.

17. The shaft rod as defined in claim 1, wherein the basic body is a profiled aluminum member, and the reinforcing element is formed of fiber reinforced plastic.

18. The shaft rod as defined in claim 1, wherein the recess is closed on five sides.

* * * * *